United States Patent [19]

Anolick et al.

[11] 4,063,713

[45] Dec. 20, 1977

[54] GUARD RAIL

[75] Inventors: Colin Anolick; Howard James Kutsch, both of Wilmington, Del.

[73] Assignee: E. I. Du Pont de Nemours and Company, Wilmington, Del.

[21] Appl. No.: 762,827

[22] Filed: Jan. 26, 1977

[51] Int. Cl.[2] ..... E01F 15/00

[52] U.S. Cl. ..... 256/13.1; 248/66; 293/88

[58] Field of Search ..... 256/1, 13.1, 19; 248/66; 293/89, 88, 71 R, 60; 267/139, 140; 114/219

[56] References Cited

U.S. PATENT DOCUMENTS

| | | | |
|---|---|---|---|
| 1,922,878 | 8/1933 | Boyle | 256/13.1 |
| 2,193,081 | 3/1940 | Super | 267/21 A |
| 3,694,019 | 9/1972 | Carter | 293/88 X |
| 3,766,146 | 10/1973 | Witsiepe | 260/75 R |

*Primary Examiner*—Andrew V. Kundrat

[57] ABSTRACT

A shock-absorbing unit comprising a post with upper and lower generally coparallel passages therethrough, e.g., bores, for the reception of individual push rods, the inboard ends of the push rods supporting a rail, an oriented elastomer, e.g., a copolyetherester, connecting the outboard end of the push rods and the post, and means for pretensioning the elastomer, e.g., a wedge, a predetermined amount.

8 Claims, 3 Drawing Figures

GUARD RAIL

BACKGROUND OF THE INVENTION

The present invention is directed to a shock-absorbing unit for vehicle barriers and, more particularly, to a shock-absorbing unit for cushioning the impact of a vehicle that hits a safety barrier or a guard rail.

Vehicle barriers such as highway guard rails are designed to stop or to return a misdirected vehicle into a direction approximately parallel to the guard rail with a deceleration acceptable to the occupants of the vehicle. Their primary function is to increase the length of time of the entire event of stopping or redirecting the vehicle, to increase the distance through which the impact energy is alleviated, and to reduce correspondingly the forces of deceleration on the passengers of the car.

Highway guard rails are adapted to intercept an impacting vehicle at a low angle of incidence and are placed in generally parallel alignment with the direction of traffic flow along shoulders of a roadway, along median strips of a divided highway and elsewhere wherever movement off the highway would be hazardous to the vehicle and its passengers. Thus, the guard rail should not only be a mechanical guide but should also function as a shock absorber that dissipates the kinetic energy of the vehicle tending to leave the road and causing immobilization along the guard rail without violently rebounding the vehicle onto the traveled lanes. However, a problem has existed in designing highway guard rails in such a manner that they have both the strength to retain the vehicle and the ability to absorb the force of impact. For example, a conventional highway guard rail structure in common usage comprises lengths of a heavy corrugated or profiled sheet metal strip spanning a plurality of inflexible posts, usually of wood or concrete, arranged in spaced apart relationship along the side of a road, the lengths of sheet metal strip overlapping at their ends. Such a guard rail possesses high elasticity so that vehicles colliding with the rail are often rebounded into the path of moving traffic. Guard rail structures of lower resiliency featuring hollow or foam-reinforced sheet metal profiles and flexible posts are known but suffer the disadvantage of high cost.

Vehicle barriers such as safety barriers are designed to receive the impacting vehicle at a high angle of incidence and are located at the gore noses of highway exit ramps, at the ends of parallel bridges or highway rails, or in front of pilings of overhead crossing bridges, massive posts, signs, buildings or other unyielding obstacles with which an out of control vehicle might collide. Conventional safety barriers have been formed from crushable metals and plastics, but they are permanently deformed by an impacting vehicle and must be replaced after each incident as they are incapable of self restoration to usefulness. Safety barriers featuring metal springs as the means of absorbing the impact elastically store too much of the energy and consequently tend to rebound the vehicle after the impact.

The present invention provides a reusable vehicle barrier having sufficient elasticity to absorb the force of impact while, at the same time, it is not so elastic as to rebound the vehicle into the path of moving traffic.

SUMMARY OF THE INVENTION

The present invention is directed to a shock-absorbing unit for vehicle barriers comprising, in combination, a post provided with upper and lower generally coparallel passages therethrough for the reception of individual push rods, the inboard ends of said push rods supporting a rail, an oriented elastomer member connecting the outboard end of said push rods, and said post, and means for pretensioning the elastomer member a predetermined amount thereby affording an energy absorber responsive to displacement of the push rods under impact. Means for supporting the oriented elastomeric member is fixed to the outboard ends of said push rods. Preferably, the elastomeric member is in the form of a belt encircling said support means and said post between said passages. Conveniently, the oriented elastomeric member is pretensioned by employing at least one spacer located between the post and the belt support means. Generally, means for supporting the elastomeric member is a plate or rod spanning the push rods. The oriented elastomer preferably is a copolyetherester.

DESCRIPTION OF THE DRAWING

The above features and advantages of the present invention become more readily apparent from the following description, reference being made to the accompanying drawing in which.

DETAILED DESCRIPTION OF THE INVENTION

While it is recognized that the shock-absorbing unit of this invention for vehicle barriers such as safety barriers and guard rails can be used in different environments, for example, parking lots, alongside buildings, in docks, etc., it is particularly applicable to use along highways, and it will be hereinafter described primarily in relation to that principal field of application.

Figure 1:
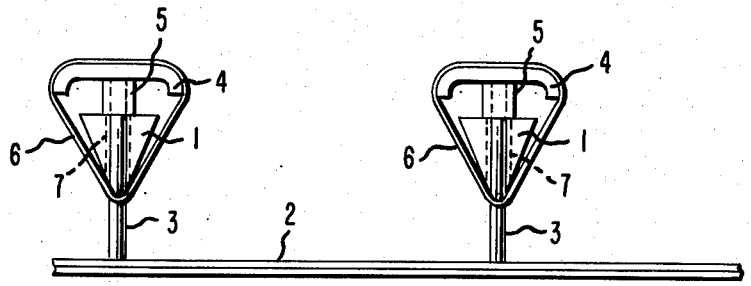
FIG. 1 is a plan view of the device of the invention in the form of a highway guard rail.
Figure 2:
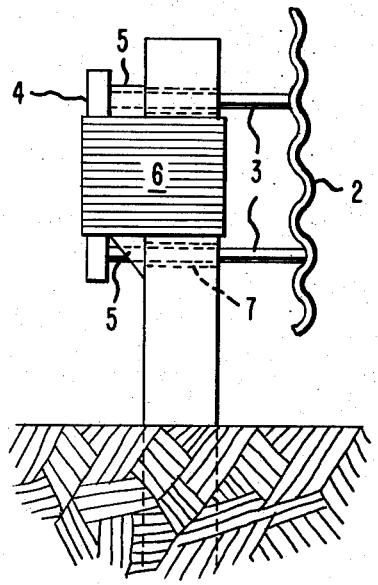
FIG. 2 is a side elevation of the device.

Referring to FIG. 1 and FIG. 2 of the drawing depicting a highway guard rail, post 1 is provided with generally coparallel passages 7 normally aligned with respect to the border of the highway for passage of push rods 3. Post 1 can be of any shape, e.g., rectangular or square, and it is generally made of wood or cement. The push rods are usually made of metal, e.g., steel. Rail 2 is mounted on the inboard end of push rods 3 by any suitable means, e.g., bolted or riveted. The rail can be the usual steel rail used on most guard rails or various modifications thereof, such as rubber or foam plastic reinforced guard rails. An oriented elastomeric belt 6, preferably a copolyetherester elastomer, is wrapped around post 1 between coaligned passages 7 and support means plate 4 for holding belt 6. The belt is pretensioned to a predetermined amount and this can be accomplished by any convenient means, for example, inserting a spacer 5 that functions as a pretensioner lock. Conveniently, the spacer can be a "U" shaped wedge located between post 1 and plate 4, the depth of the spacer determining the degree of pretensioning of belt 6. If desired, a skid support can be mounted anywhere along lower push rod 3 to better hold the rail in proper position upon impact by a vehicle.

Figure 3:
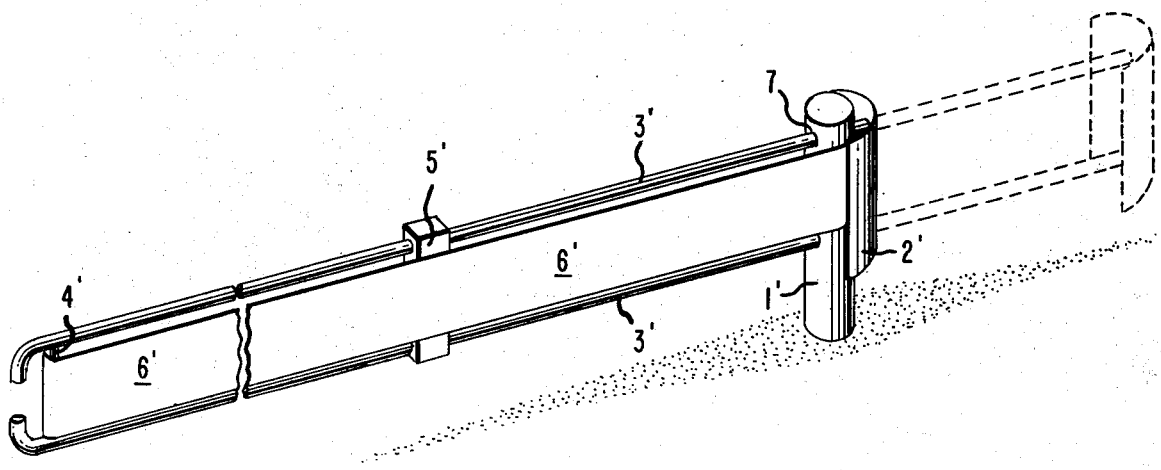
FIG. 3 is a perspective view of the device in the form of a safety barrier shown in the position reached at full impact.

FIG. 3 illustrates a safety barrier for vehicles that is a modification of the highway guard rail shown in FIGS. 1 and 2 and is designed to receive the impacting vehicle at a high angle of incidence. Again support post 1' is provided with generally coparallel passages 7' for passage of push rods 3'. Rail 2' is mounted on the inboard end of said push rods. The elastomeric member 6' encircles post 1' between coaligned passages 7' and support means bar 4', spanning both push rods. The primary difference between the illustrations is that in FIG. 3 spacer 5' comprises a clamp fixed to push rods 3' to prevent its movement along said rods and to maintain a fixed minimum space between bar support means 4' and post 1' necessary to pretension belt 6' a predetermined amount. Thus, belt 6' can be pretensioned a predetermined amount by appropriate placement of the spacer clamp on rod 3'. When the device is in position ready for operation spacer 5' rests against post 1', thus maintaining tension on oriented elastomer belt 6'.

The elastomeric member of the device, represented in the drawings as belt 6, is an oriented elastomer and preferably an oriented copolyetherester elastomer. A copolyetherester elastomer used to form the belt consists essentially of multiplicity of recurring long-chain and short-chain ester units joined head-to-tail through ester linkages, said long-chain ester units being represented by the structure:

$$-OGO-\overset{O}{\overset{\|}{C}}R\overset{O}{\overset{\|}{C}}-$$

and said short-chain ester units being represented by the structure:

$$-ODO-\overset{O}{\overset{\|}{C}}R\overset{O}{\overset{\|}{C}}-,$$

wherein:

G is a divalent radical remaining after removal of terminal hydroxyl groups from poly(alkylene oxide) glycols having a molecular weight between about 400–6000, e.g., poly(tetramethylene oxide) glycol;

R is a divalent radical remaining after removal of carboxyl groups from a dicarboxylic acid having a molecular weight less than about 300, e.g., phthalic, terephthalic or isophthalic acids; and D is a divalent radical remaining after removal of hydroxyl groups from a low molecular weight diol having a molecular weight less than about 250; said short-chain ester units constitute about 15–95% by weight of the copolyetherester and said long-chain ester units constitute the balance.

The copolyetheresters can be made conveniently by a conventional ester interchange reaction. A preferred procedure involves heating the dicarboxylic acid, e.g., dimethyl ester of terephthalic acid, phthalic or isophthalic acid, with a long-chain glycol, e.g., poly(tetramethylene oxide) glycol having a molecular weight of about 600–2000 and a molar excess of diol, e.g., 1,4-butanediol, in the presence of a catalyst at about 150°–260° C and a pressure of 0.5 to 5 atmospheres, preferably ambient pressure, while distilling off methanol formed by the ester interchange. Thus, preferably, in the above formula G is the group remaining after removal of hydroxyl groups from poly(tetramethylene oxide) glycol having a molecular weight of about 600–2000; R is the group remaining after removal of carboxyl groups from phthalic, terephthalic or isophthalic acids or mixtures thereof, and D is the group remaining after removal of hydroxyl groups from 1,4-butanediol. At least about 1.1 mole of diol should be present for each mole of acid, preferably at least about 1.25 mole of diol for each mole of acid. The long-chain glycol should be present in the amount of about 0.0025 to 0.85 mole per mole of dicarboxylic acid, preferably 0.01 to 0.6 mole per mole of acid.

Preferred copolyesters are those prepared from dimethyl terephthalate, 1,4-butanediol, and poly(tetramethylene oxide) glycol having a molecular weight of about 600–2000 or poly(ethylene oxide) glycol having a molecular weight of about 600–1500. Optionally, up to about 30 mole percent and preferably 5–20 mole percent of the dimethyl terephthalate in these polymers can be replaced by dimethyl phthalate or dimethyl isophthalate. Other preferred copolyesters are those prepared from dimethyl terephthalate, 1,4-butanediol, and poly(propylene oxide) glycol having a molecular weight of about 600–1600. Up to 30 mole percent and preferably 10–25 mole percent of the dimethyl terephthalate can be replaced with dimethyl isophthalate or butanediol can be replaced with neopentyl glycol until up to about 30% and preferably 10–25% of the short-chain ester units are derived from neopentyl glycol in these poly(propylene oxide) glycol polymers.

The copolyetherester compositions comprising belt 6 may also contain up to about 5 weight percent of an antioxidant, e.g., between about 0.2 and 5 weight percent, preferably between about 0.5 and 3 weight percent. The most preferred antioxidants are diaryl amines such as 4,4'-bis(α,α-dimethylbenzyl) diphenylamine.

The most preferred copolyetherester compositions comprising belt 6 may also contain up to about 5 weight percent of an antioxidant, e.g., between about 0.2 and 5 weight percent, preferably between about 0.5 and 3 weight percent. The most preferred antioxidants are diaryl amines such as 4,4'-bis(α,α-dimethylbenzyl) diphenylamine.

Belts of the oriented copolyetherester can be formed in a number of ways. For example, a billet can be molded from the polymer in a conventional manner and the billet oriented by stretching, heat setting, and cooling. The copolyetherester belt is oriented by stretching the copolyetherester by conventional means at least 300% of its original length and preferably at least 400% at a temperature below its melting point by at least 20° F. It is maintained at that length and brought to or maintained at a heat setting temperature between 150° and 20° F below its melting point. It is then cooled to a temperature below the heat setting temperature by at least 100° F.

The copolyetheresters used to make the elastomeric member are further described in Witsiepe, U.S. Pat. No. 3,766,146, and the oriented copolyetheresters are also described in Brown and McCormack, Ser. No. 542,257, filed Jan. 20, 1975, the disclosures of which are incorporated herein by reference.

The oriented copolyetherester is, preferably, in the form of a belt encircling post 1 and plate 4 and most preferably is a lapped belt having multiple windings. A lapped belt can be fabricated conveniently by making multiple windings of a tape or belt of oriented elastomer around said post and support means, e.g., plate or bar, as the case may be, and securing the belt from unwinding by suitable means, e.g., heat or solvent welding the free ends to the adjacent strip of belt, or clamps or other fasteners. The number of windings of the belt will depend upon the weight of the belt needed for a particular energy absorbing capacity as described below.

To prepare the shock-absorbing mechanism shown in FIGS. 1 and 2 for operation, belt 6 is prestressed by inserting spacer 5, for example, a "U"-shaped metal wedge, between post 1 and plate 4. Thus, the displacement of plate 4 stretches belt 6 and places it under tensile stress, as shown in FIG. 1. The belt is of such length that such displacement causes the desired degree of prestressing and provides high initial impact force for greater energy absorption. Impact upon rail 2 causes push rods 3 to move in a direction toward their outboard end relative to post 1. The distance between the support means for the belt and the post that is maintained by spacer 5 determines the degree of tensioning and stretching of belt 6 whereby the energy of impact is absorbed and the movement of rail 2 is cushioned. As can be seen from FIG. 3, the safety barrier device illustrated therein operates in the same manner. Spacer 5 is a clamp that is so positioned on push rods 3' that the elastomeric belt 6' in the operating condition is pretensioned. Some of the energy absorbed is reversibly stored in the belt and is used to return the shock-absorbing device to its original position and the remainder of the energy is dissipated. Thus, after the impact is so dissipated, push rods 3 and rail 2 return to their original positions as a consequence of the elastic nature of belt 6 with spacer 5 again resting against post 1 and plate 4 and the shock-absorbing unit is ready to function again, when needed, in the manner described above.

Dimensions of belt 6 of oriented elastomer and the depth of spacer 5 will depend upon the amount of energy required to be absorbed by the shock absorbing mechanism and the desired rate of absorption. Factors which increase the energy absorbing capacity are: (1) enlarging the cross-sectional area of the belt, (2) increasing the potential displacement of the rail by lengthening the push rods and the belt, and hence, increasing the ultimate stretch and stress level of the extended belt, and (3) increasing the degree of prestressing of the belt by increasing the depth of spacer 5. Selecting a higher modulus elastomer for fabrication of belt 6 is another factor that can be used to increase energy absorbing capacity of the shock-absorbing unit. For highway guard rails and dock guards the above specifications will vary because of varying energy absorption requirements and varying limitations on maximum force and maximum deflection. A typical belt for a guard rail, as represented in FIGS. 1 and 2, when made of the preferred oriented copolyetherester elastomer, as referred to above, has a cross-sectional area of about 2.6 sq. cm. and a circumference of about 102 cm, weighs about 0.67 kg., and the depth of spacer 5 will be sufficient to permit the belt to be prestrained by stretching to about 10% of its original length. This belt when struck by a vehicle at an angle of incidence of about 10° and stretched to a maximum strain of 40% will exert a maximum total restoring force of 2380 pounds. A safety barrier because of its exposure to impacts of high angle incidence must have a greater energy absorbing capacity than a guard rail and consequently will have a larger belt. The stopping distance for the impacting vehicle and the maximum force developed will be directly and inversely proportional, respectively, to the original length and cross-sectional area of the belt. Typically, a belt capable of absorbing the full energy of a 3000 pound vehicle in impact at an angle of 90° at an initial speed of 50 miles per hour weighs 11.3 kg. (25 lbs.), has a cross-sectional area of 4.3 sq. cm. and a circumference of 2030 cm., is installed with a 10% prestrain, and stretched in impact to 40% strain. The vehicle is stopped within about 10 feet after impact with a maximum total force of about 40,000 pounds and a maximum deceleration of about 13.2 G.

We claim:

1. A shock-absorbing unit for vehicle barriers comprising, in combination, a post provided with upper and lower generally coparallel passages therethrough for the reception of individual push rods, the inboard ends of said push rods supporting a rail, means for supporting an oriented elastomeric belt fixed to the outboard ends of said push rods, said belt of oriented elastomer encircling said support means and said post between said passages, and means for pretensioning the elastomeric member a predetermined amount thereby affording an energy absorber responsive to displacement of the push rods under impact.

2. A shock-absorbing unit of claim 1 wherein means for pretensioning the elastomer is at least one spacer placed between said support and said guide means.

3. A shock-absorbing unit of claim 1 wherein said spacer is a clamp.

4. A shock-absorbing unit of claim 1 wherein said spacer is a wedge.

5. A shock-absorbing unit of claim 1 wherein the belt is a copolyetherester elastomer.

6. A shock-absorbing unit of claim 1 wherein the elastomer is a copolyetherester consisting essentially of a multiplicity of recurring long-chain and short-chain ester units joined head-to-tail through ester linkages, said long-chain ester units being represented by the structure:

$$-\mathrm{OGO}-\overset{\overset{\mathrm{O}}{\|}}{\mathrm{C}}\mathrm{R}\overset{\overset{\mathrm{O}}{\|}}{\mathrm{C}}-$$

and said short-chain ester units being represented by the structure:

$$-\mathrm{ODO}-\overset{\overset{\mathrm{O}}{\|}}{\mathrm{C}}\mathrm{R}\overset{\overset{\mathrm{O}}{\|}}{\mathrm{C}}-$$

wherein:

G is a divalent radical remaining after removal of terminal hydroxyl groups from poly(alkylene oxide) glycols having a molecular weight between about 400–6000;

R is a divalent radical remaining after removal of carboxyl groups from a dicarboxylic acid having a molecular weight less than about 300; and D is a divalent radical remaining after removal of hydroxyl groups from a low molecular weight diol having a molecular weight less than about 250;

said short-chain ester units constitute about 15–95% by weight of the copolyetherester.

7. A shock-absorbing unit of claim 6 wherein G is the group remaining after removal of hydroxyl groups from poly(tetramethylene oxide) glycol having a molecular weight of about 600–2000; R is the group remaining after removal of carboxyl groups from phthalic, terephthalic or isophthalic acids or mixtures thereof; and D is the group remaining after removal of hydroxyl groups from 1,4-butanediol.

8. A shock-absorbing unit of claim 6 wherein the belt has multiple wrappings.

* * * * *